United States Patent [19]

Nishioka et al.

[11] 4,036,386

[45] July 19, 1977

[54] VENTING CLOSURE ASSEMBLY

[75] Inventors: Masato Nishioka; Daniel Dulaney Carter, both of Cincinnati, Ohio

[73] Assignee: The Procter & Gamble Company, Cincinnati, Ohio

[21] Appl. No.: 696,145

[22] Filed: June 14, 1976

[30] Foreign Application Priority Data

July 9, 1975 Philippines ..... 17362

[51] Int. Cl.[2] ..... B65D 51/16

[52] U.S. Cl. ..... 215/260

[58] Field of Search ..... 215/260, 261, 270; 220/203, 204, 208, 209

[56] References Cited

U.S. PATENT DOCUMENTS

| | | | |
|---|---|---|---|
| 2,032,931 | 3/1936 | Gibbs | 215/260 |
| 2,965,257 | 12/1960 | Lipman | 215/260 |
| 3,022,918 | 2/1962 | Smith | 215/260 |
| 3,114,467 | 12/1963 | Montgomery | 215/260 |
| 3,174,641 | 3/1965 | Kitterman | 215/260 |
| 3,393,818 | 7/1968 | McIntosh | 215/260 |
| 3,589,545 | 6/1971 | Carpenter | 215/260 |

*Primary Examiner*—Donald F. Norton

*Attorney, Agent, or Firm*—Elliot A. Lackenbach; John V. Gorman; Richard C. Witte

[57] ABSTRACT

A venting closure is provided which retains the contents of a screw-top container yet prevents distortion of the latter under the influence of a pressure differential applied from without. It consists of a cap fitted with a gasket which is supported circumferentially around the entire rim of the container by a plurality of flanges which at no point have a pitch greater than that of the screw threads; and which are disposed in relation to one another so as to permit air that has passed from the outside of the container along the container threads to enter the space between the gasket and the underside of the cap. The gasket normally seals against a central boss depending from the cap underside; however when external pressure exceeds that within the container by a predetermined level it momentarily lifts the gasket from its seat, admits air into the container through a central hole in the gasket, and tends to equalize the pressures.

3 Claims, 8 Drawing Figures

VENTING CLOSURE ASSEMBLY

This invention relates to a closure assembly for containers, and more particularly to a closure assembly which can vent to allow atmospheric air to enter the container under certain conditions but prevents the passage of the contents therefrom.

Many fluid materials are conveniently and economically packaged in plastic bottles. If the fluid is warm when admitted into the containers and sealed, and is subsequently cooled, the pressure within the bottles becomes reduced. This effect can also occur if the bottles are packaged at a high altitude manufacturing facility and shipped to sea level for sale.

Due to the flexible nature of such plastic bottles, their shape distorts or "collapses" under this differential pressure and presents an unsightly appearance. The amount of such distortion is affected by the size and shape of the bottles and the composition and thickness of the plastic resin used for the bottle walls as well as by the magnitude of the pressure differential.

Bottle collapse is a recognized problem in the packaging arts and has previously been given attention by packaging engineers and designers. It has been already appreciated that atmospheric air can pass along the helical canal adjacent to the threads and thereby reach the peripheral juncture of the inner surfaces of the top wall and the side skirt of the cap. Some prior art closure assemblies have provided a gasket support flange oppositely disposed to the container neck, with one or more narrow axial gaps in the flange whereby air is admitted to the central underside surface of the cap. Also valve mechanisms have been provided which operate in the manner of a check valve flap to admit atmospheric air when the pressure without the container is greater than that within the container, yet reclose to prevent leakage or evaporation of the fluid contents of the container. These closures require no changes in appearance of the cap exterior.

However these prior art devices have not been without deficiencies and have not achieved wide commercial acceptance. One common deficiency is complexity of construction: e.g. complexity of valve construction as in Kitterman, U.S. Pat. No. 3,174,641 issued on Mar. 23, 1965, and complexity of gasket construction as in Williams et al, U.S. Pat. No. 3,010,596 issued on Nov. 28, 1961. Similarly complex modes of construction for closures intended to vent excessive pressure from within a container outward to the atmosphere (i.e. in the direction opposite to that with which the instant invention is concerned) are disclosed in Gora, U.S. Pat. No. 2,739,724 issued Mar. 27, 1956; J. A. McIntosh, U.S. Pat. No. 3,286,866 issued Nov. 22, 1966 and R. B. McIntosh, U.S. Pat. No. 3,393,818 issued July 23, 1968.

Another common deficiency of prior art devices is the necessity of using complex inner molds in the cap manufacturing process. The inner mold of a threaded cap necessarily must mold the threads into the inner wall of the skirt of the cap. It is apparent that the inner mold cannot be directly retracted along the axis of the cap. Ordinarily and most simply, therefore, it is "screwed" out of the newly formed cap in a combined rotary and axial movement, following the pitch of the threads. This can be done only if none of the parts of the newly formed cap interefere with this complex motion. A gasket support flange having an axial gap does not permit this unscrewing motion without breakage. One prior art solution to this problem has been the use of a double concentric inner mold: the outer shell retracts by unscrewing as before, while the inner portion retracts axially. It can be appreciated that this mold complexity is inconvenient and uneconomic. While the device of R. B. McIntosh cited above recognized this deficiency, its construction is adapted solely to vent air outwardly from the inside of the container, and not vice versa.

Another prior art solution to the axial gap problem is to mold one or more axial gaps into a separate piece which is then inserted into the cap. This is also both inconvenient and uneconomic. Alternatively, such axial passages can be in the gasket as in Kitterman, which again adds complexity.

It is an object of this invention to provide a venting closure which solves the bottle distortion problem hereinbefore described.

It is also an object of this invention to provide a venting closure all parts of which are of a comparatively simple and economical design, and capable of being manufactured by comparatively simple and economical molds.

The foregoing discussion has been given in terms of molds for making plastic caps; it will be appreciated that the same principles apply to dies for making metal caps.

To promote a clear understanding of the nature, objects, and advantages of this invention, the detailed features of a particular embodiment are illustrated in the accompanying drawings. It will be appreciated that no limitation on the scope of the invention is thereby intended.

Figure 1:
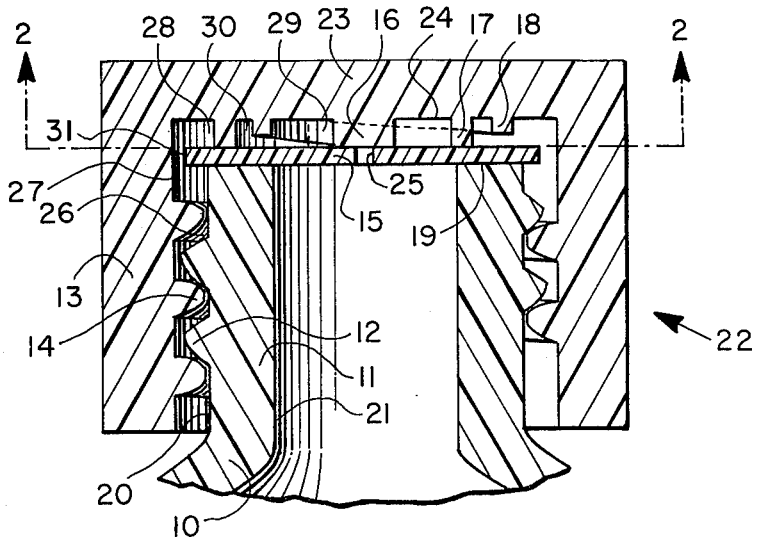
FIG. 1 is a fragmentary cross-sectional view taken through the central axis of an embodiment of this invention showing a container, cap, and gasket in seating position relative to one another.
Figure 3:
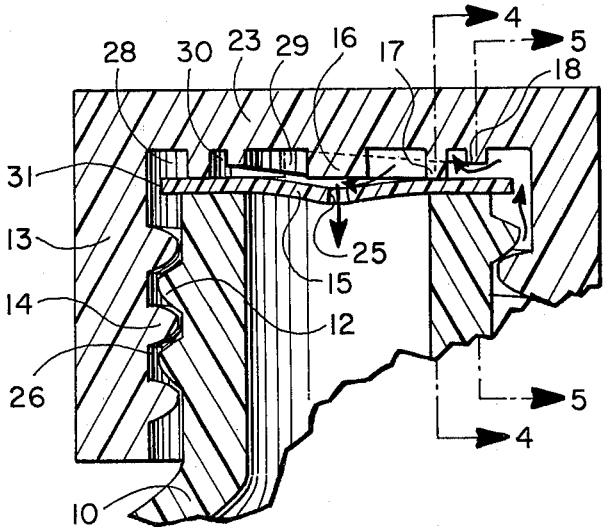

FIG. 3 is a fragmentary cross-sectional view similar to FIG. 1 but showing the venting action of the gasket under the influence of an externally applied pressure. By externally applied is meant the situation wherein the pressure outside the container is greater than the pressure inside the container. This can be, and often is, because a subatmospheric pressure, i.e. a vacuum, develops within the container.

Figure 4:
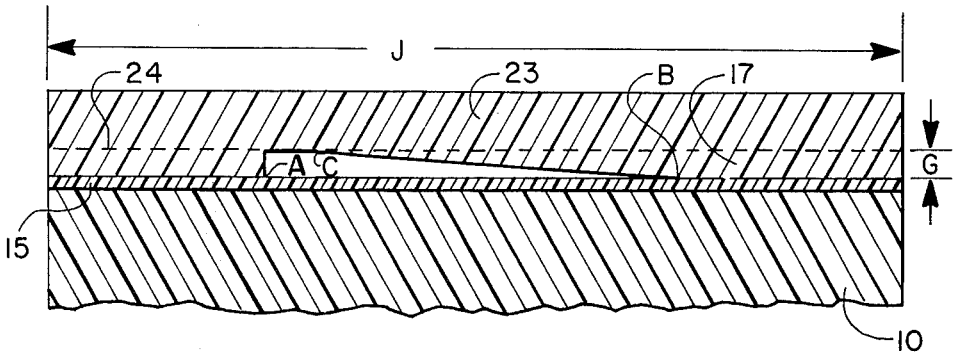
Figure 5:
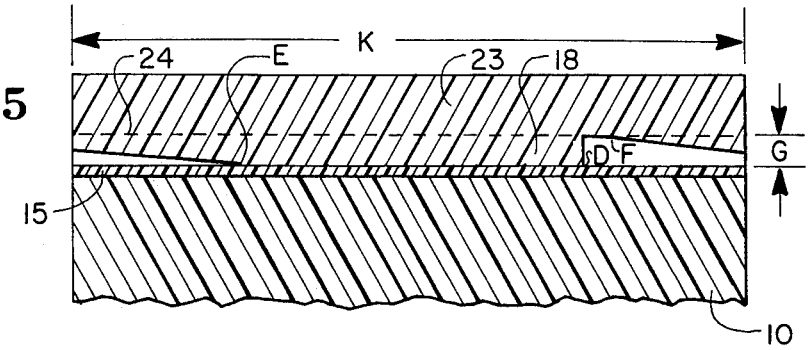

FIGS. 4 and 5 are developed surfaces taken along lines 4—4 and 5—5, respectively, of FIG. 3 looking in the direction of the arrows, showing two spaced gasket flanges tapered for a right-hand threaded closure.

Figure 6:
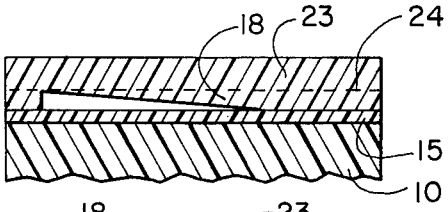
Figure 7:
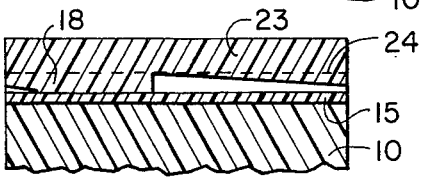
Figure 8:
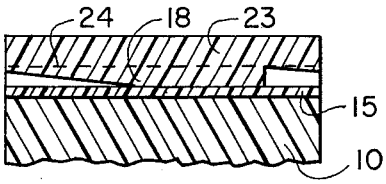

FIGS. 6, 7, and 8 are developed surfaces, analagous to those of FIGS. 4 and 5, showing an alternative construction utilizing three circumferential gasket flanges which are contiguous.

Referring more particularly to the drawings:

FIG. 1 shows a container 10 having a neck 11 with an inner wall 21, an outer wall 20 having threads 12, and an interconnecting rim 19 at the upper ends of the inner wall 21 and outer wall 20. Cap 22 has a top wall 23 and an internally tapped generally cylindrical skirt 13 extending downwardly from top wall 23. The cylindrical skirt 13 is tapped to provide threads 14 which mate with threads 12 on the container neck 11.

Cap 22 is made of relatively rigid material, such as metal or preferably hard plastic. Cap 22 may assume any desirable size or configuration within the scope of this invention.

Depending downwardly and inwardly from the inner surface 24 of top wall 23 is a boss 16 located centrally with respect to inner surface 24.

Also depending downwardly and inwardly from the inner surface 24 of top wall 23 are two staggered circumferential flanges, inner flange 17 and outer flange 18. Both flanges are concentric with skirt 13 and are disposed directly opposite rim 19 of container 10.

Flexible resilient gasket 15 is a disc-like member located between rim 19 of container 10 and flanges 17 and 18 of wall 23. When the closure is screwed down tightly in seating position, gasket 15 is firmly supported between rim 19 and the full depth portions of flanges 17 and 18 which are described in detail hereinafter. Gasket 15 does not seat against the inner surface 27 of skirt 13, and in fact is spaced apart from it around at least some portions of its periphery by a clearance 31, herein called a skirt/gasket clearance. Gasket 15 has a centrally located hole 25, around the periphery of which the gasket is in sealing engagement with boss 16 when the pressures within and without container 10 are equal.

The continuous threads 14 and 12 of the cap and container neck, respectively, define a canal 26 which, together with the skirt/gasket clearance 31, provide constant communication of atmospheric air with peripheral chamber 28 located within the interior portion of the closure adjacent to the peripheral juncture of the inner surface 24 of top wall 23 and the inner surface 27 of skirt 13.

Peripheral chamber 28 is also in constant communication with annular chamber 29 located between gasket 15 and top wall 23 and between flanges 17, 18 and boss 16. The means by which this communication is established will now be described.

Flanges 17 and 18 are each generally helical in form and, as described supra, concentric with skirt 13 and disposed directly opposite rim 19 of contaner 10. Opposite substantially the entire periphery of rim 19 one or the other of these flanges is at a full, constant depth, where depth is measured in the downward direction, i.e. parallel to the axis of the closure. Taken together, the flanges provide support for the upper surface of the gasket around its entire circumference. Because there are two flanges, at any circumferential point only one flange need be at its full depth for gasket support purposes, while the other can have any depth which is equal to or smaller than the full depth. It can now be appreciated that peripheral chamber 18 is in communication with annular chamber 29 via the following canal: transversely across and below outer flange 18 where flange 18 is not at its full depth; part way circumferentially around annular channel 30 situated between flanges 18 and 17; and transversely across and below inner flange 17 where flange 17 is not at its full depth.

According to this invention each portion of flanges 17 and 18 that is not at its full depth is tapered in the general form of a helix having a pitch that is equal to, or less than, the pitch of threads 12, 14 and is in the same direction.

Figure 2:
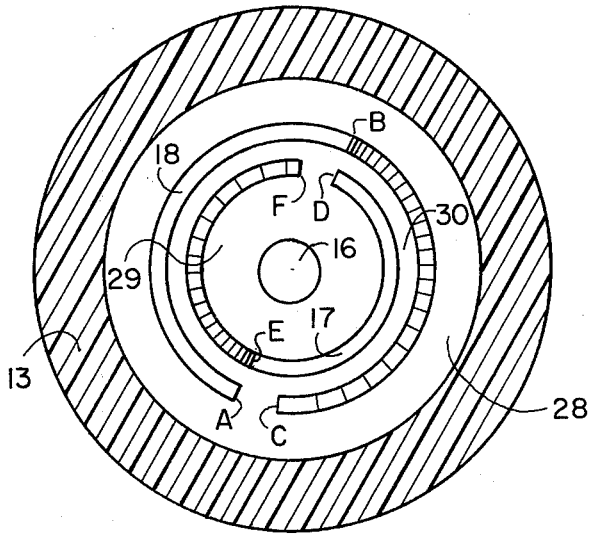
FIG. 2 is a sectional view taken along line 2—2 of FIG. 1.

The form of flanges 17 and 18 can be further described by references to FIGS. 2, 4 and 5. Outer flange 18 is at full depth G between points A and B, while inner flange 17 is at full depth G between points D and E. Between points B and C the lower surface of outer flange 18 is generally helical in configuration, while between points E and F the lower surface of inner flange 17 is generally helical. On FIGS. 4 and 5, J and K designate complete circumferences of outer flange 18 and inner flange 17, respectively.

FIGS. 1 through 5 show, for convenience and clarity of representation, two gasket supporting flanges spaced radially apart from one another; each flange is shown at its full depth for approximately 180° circumferential while, at corresponding portions of the circumference, the other flange is shown helically tapered. However these drawings, and the words "generally helical" as used herein, are not meant to imply that the tapered portions of the flanges necessarily have a uniform pitch. What is required is that at every point on the tapered portions of flanges 17 and 18 the pitch is equal to, or less than, the pitch of threads 12, 14. This criterion can be applied, in fact, to the entirety of flanges 17 and 18 because the gasket supportive portions where the flanges are at their full depth can be viewed in the limit as helixes having a pitch of zero.

The usual complex rotary/axial retraction motion of the inner molds in the ordinary cap manufacturing process has been described hereinbefore. It can now be appreciated that, when the pitch of the tapered portions of the gasket supporting flanges have a pitch equal to the pitch of the cap threads the mold slides along the tapered flange portions as it is "unscrewed". When the pitch is less than that of the threads, the mold immediately clears the tapered flange portions as it unscrews, as indeed it clears the full depth portions of the flanges and the other parts of the cap underside. Thus one object of this invention has been accomplished, viz. a cap capable of being manufactured by comparatively simple and economical molds or dies.

The generally rectangular cross-sections of flanges 17 and 18 as shown in the drawings are not intended to imply that the cross-sections are limited to this shape. It will, however, be appreciated that the gasket supporting portions thereof are preferably flat or smoothly rounded on the bottom to avoid damage to the gasket.

Also, the gasket supporting flanges of this invention are not limited to being two in number with a space between. Rather a plurality of staggered circumferential flanges is needed such that at least one is at its full depth opposite substantially the entire periphery of the container rim, while open passages are provided to interconnect, when the cap and gaskets are seated in relation to one another, those flange portions which are not at their full depth. A particular construction involving three contiguous circumferential flanges, i.e. three non-spaced flanges abutting side to side, is represented by FIGS. 6, 7, and 8 which are analogous to FIGS. 4 and 5 for two spaced flanges. It is readily apparent from the drawings that when the three flanges are side by side in contiguous, abutting relationship, and the cap is seated against the gasket, the open spaces interconnect in such a way as to permit transverse air flow completely across the three flanges. Similarly for four or more contiguous flanges which need not be circumferentially symmetrical but which need only to leave, when the cap is seated against the gasket, an interconnected free channel permitting transverse air flow completely across all flanges.

The roots of the flanges, designated as points C and F on FIGS. 4 and 5 respectively, are shown as slightly spaced apart circumferentially from the beginning of the respective full depth portions of the flanges. The length of this space is in no wise critical, and is shown for comparison on FIGS. 6, 7 and 8 as vanishingly small.

When pressures within and without chamber 10 are equal, annular chamber 29 does not communicate with the interior of container 10. However when air pressure outside the container rises, gasket 15 flexes downwardly sufficiently to lift its upper surface away from boss 16 and permit the admission of air into the interior of container 10 through hole 25. When the pressure has equalized sufficiently, gasket 15 returns to its normal position due to its flexible and resilient nature, once again making sealing engagement with boss 16.

FIG. 3 illustrates gasket 15 in its flexed position for admission of air into the interior of container 10. A series of arrows illustrates the admission of atmospheric air into canal 26; therethrough along threads 14, 12; into peripheral chamber 28; transversely across and below outer flange 18; part way circumferentially around annular chamber 30 between flanges 18 and 17; axially across and below flange 17 into annular chamber 29; between boss 16 and gasket 15 in its flexed position; and through hole 25 into the interior of container 10.

Gasket 15 can be made from any flexible, resilient material that is not chemically or physically affected by the intended contents of the container and that is not porous thereto. Examples of suitable gasket materials are rubber, both natural and synthetic, and closed cell foam polyethylene. Cork can be utilized under appropriate conditions. However paper and foil are not suitable because they are "dead" and lack the necessary resiliency. Laminated gaskets are eminently suitable, wherein a resilient material that lacks stability toward the environment to which it is exposed is laminated to a material impervious to its surroundings but lacking in resiliency.

Gasket 15 can be made by merely stamping from a flat sheet of appropriate resilient material; molding is not required. Within the scope of this invention, the gasket can fit loosely into the cap; however the skirt/gasket clearance 31, in this case substantially annular in form, should be small enough that, as the gasket shifts sideways in relation to the cap, the gasket is always disposed directly opposite to outer flange 18 so as to maintain continuous circumferential support, and hole 25 is always directly opposite boss 16 so as to maintain check-valve action.

More conveniently, gasket 15 is fabricated to be physically held in assembled relationship to the upper portion of the cap after it has been inserted therein. One way to accomplish this purpose is to make gasket 15 slightly larger in diameter than the diameter of the inner surface 27 of cap skirt 13. Such a gasket, due to its resilient nature, will deform enough to be pressed past threads 14; it will then recover nearly its original flat form and will be tightly restrained against the inner surface 27 of skirt 13 in its functioning position as hereinbefore described. For this configuration, one or more shallow notches in the edge of the gasket will serve as an appropriate skirt/gasket clearance.

Alternatively, gasket 15 can be of approximately the same diameter as the outer edge of neck rim 19, and be held concentric with the cap axis by means of spaced lateral protuberances extending to the inner skirt wall 27 which serve to maintain a friction fit thereto. Such protuberances are conveniently integral with the gasket, and a plurality of 3 or more equally spaced protuberances are especially convenient. Protuberances of this kind are well known to the skilled artisan, and are illustrated in Miller, U.S. Pat. No. 3,339,772 issued Sept. 5, 1967. Here the interrupted circumferential spaces between protuberances serve as the skirt/gasket clearance.

It is apparent from the foregoing that, while a skirt/gasket clearance is a part of this invention, the shape and size thereof are in no way critical. Similarly, the precise dimensions of flanges 17 and 18, boss 16 and hole 25, and the thickness, shape and composition of gasket 15 are not critical to the practice of this invention. With the teachings of this specification before him, a packaging engineer or designer can easily design a venting closure to serve his particular needs and predilections. For example, it would be apparent to him that increasing the depth of boss 16 beyond that of flanges 17 and 18 increases the tension on resilient gasket 15 and thereby raises the pressure differential required to lift the gasket and vent air into the container. In like manner, it is apparent that a similar result occurs if the gasket is stiffened by thickening it or by fabricating it from a less flexible material. Also the ambient temperature and the capping torque affect the characteristics of the gasket so as to change the minimum pressure differential which causes venting to take place. These matters, too, are within the understanding of packaging artisans.

In assembling filled containers of the type contemplated by this invention, all caps should be seated against their gaskets with an appropriate and substantially similar degree of torque. Too little torque will not ensure a proper seal, while too much torque may possibly, depending on the materials used and their geometry, distort or damage the gaskets so they do not consistently vent at the intended pressure differential. Appreciation for proper torque is within the skill of an artisan in this field.

A venting closure of this invention was constructed as follows: cap material — injection molded high density polyethylene; cap exterior diameter — 28 mm.; cap interior diameter — 24 mm.; skirt height — 17 mm.; depth of flanges — 1.6 mm.; depth of boss — 2.1 mm.; thickness of flanges — 0.8 mm.; outer and inner diameters of outer flange — 22.0 and 19.2 mm. respectively; outer and inner diameters of inner flange — 20.4 and 17.6 mm. respectively; depth of threads — 1 mm.; pitch of threads — 3.2 mm.; diameter of central boss — 5.0 mm.; gasket material — foam polyethylene in sheet form; diameter of gasket 23 mm.; diameter of hole in gasket — 2.2 mm.; thickness of gasket — 1.0 mm; inner and outer diameters of container rim — 22 and 17 mm. respectively. The minimum external pressure differential which caused venting to take place was between about 2 and about 10 cm. of mercury, depending upon the temperature at which the test was conducted and the capping torque which had been used. The closure did not leak when the container was inverted.

From the foregoing it is apparent that this invention provides a novel and relatively simple and economical means of retaining the contents of containers, yet preventing container distortion under the influence of an external pressure differential.

What is claimed is:

1. A venting closure comprising a cap and resilient gasket adapted for use on a threaded neck container including a threaded outer wall, an inner wall, and an interconnecting rim;

wherein said cap has a top wall; a cylindrical skirt depending from said top wall having thread means for engaging the threaded outer wall of the container neck; a plurality of staggered circumferential flanges, concentric with said skirt, depending downwardly from the top wall of said cap, adapted to be oppositely disposed to the rim of said container neck; and a central boss depending downwardly from the top of said cap;

wherein each of said flanges has a full depth portion and a tapered portion in generally helical form, the pitch of which at every point is equal to or less than the pitch of the threads and is in the same direction; wherein at least one flange is adapted to be oppositely disposed to substantially the entire periphery of the rim of said container neck; and wherein the tapered portions when the cap is seated against the gasket form an interconnected open channel permitting tranverse air flow completely across said plurality of flanges;

and wherein said gasket when seated is in supporting engagement between the full depth portions of said flanges and the rim of said container neck; said gasket having a skirt/gasket clearance around at least some portions of its periphery, and a centrally located hole around the periphery of which the gasket is in sealing engagement with said boss; said gasket being adapted to flex under the influence of an externally applied pressure differential to permit the passage of air from the atmosphere into said container.

2. The closure assembly of claim 1 wherein the flanges are two in number and are in radially spaced relationship to one another.

3. The closure assembly of claim 2 wherein the pitch of the tapered portions of the flanges is equal to that of the threads.

* * * * *